US011944114B2

(12) United States Patent
Mishra et al.

(10) Patent No.: US 11,944,114 B2
(45) Date of Patent: Apr. 2, 2024

(54) SMOKELESS TOBACCO LIPID GRANULES

(71) Applicant: ALTRIA CLIENT SERVICES LLC, Richmond, VA (US)

(72) Inventors: Munmaya K. Mishra, Manakin Sabot, VA (US); Frank Scott Atchley, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 1257 days.

(21) Appl. No.: 13/922,954

(22) Filed: Jun. 20, 2013

(65) Prior Publication Data

US 2013/0340776 A1 Dec. 26, 2013

Related U.S. Application Data

(60) Provisional application No. 61/662,060, filed on Jun. 20, 2012.

(51) Int. Cl.

| | |
|---|---|
| ***A24B 15/10*** | (2006.01) |
| ***A24B 15/16*** | (2020.01) |
| ***A24B 15/18*** | (2006.01) |
| ***A24B 15/28*** | (2006.01) |

(52) U.S. Cl.

CPC ..... *A24B 15/10* (2013.01); *A24B 15/16* (2013.01); *A24B 15/186* (2013.01); *A24B 15/283* (2013.01)

(58) Field of Classification Search

CPC ..... A24B 15/16; A24B 15/283; A24B 13/00; A24B 15/10; A24B 15/186

USPC ..... 131/359, 352, 347

See application file for complete search history.

(56) References Cited

U.S. PATENT DOCUMENTS

| | | | |
|---|---|---|---|
| 3,913,847 | A | 10/1975 | Glatt et al. |
| 4,528,993 | A | 7/1985 | Sensabaugh et al. |
| 4,660,577 | A | 4/1987 | Sensabaugh et al. |
| 4,848,373 | A | 7/1989 | Lenkey |
| 5,372,149 | A | 12/1994 | Roth et al. |
| 6,153,236 | A | 11/2000 | Wu et al. |
| 6,251,478 | B1 | 6/2001 | Pacifico et al. |
| 6,312,741 | B1 | 11/2001 | Navarro |
| 6,616,954 | B1 | 9/2003 | Dally et al. |

(Continued)

FOREIGN PATENT DOCUMENTS

| | | | | |
|---|---|---|---|---|
| EP | 0167370 | * | 4/1990 | ..... A24B 3/14 |
| EP | 2377413 | | 10/2011 | |
| WO | WO 2007/037962 | | 4/2007 | |

OTHER PUBLICATIONS

Blog post entitled "How to Substitute Eggs and Binding Agents." 1 page, posted posted Oct. 19, 2011. Retrieved from Internet: <http://www.myrealfoodlife.com/part-2-how-to-substitute-eggs-and-binding-agents/>.*

(Continued)

*Primary Examiner* — Galen H Hauth
*Assistant Examiner* — Yana B Krinker
(74) *Attorney, Agent, or Firm* — Harness, Dickey & Pierce, P.L.C.

(57) ABSTRACT

A smokeless tobacco product includes a plurality of orally disintegrable granules. Each granule has a lipid core and at least one layer surrounding the core. The core can also include binders, powdered tobacco carbohydrates, water soluble polymers, flavorants, salts, sweeteners, and combinations thereof. The orally disintegrable granules can provide a pleasing texture and/or flavor experience.

18 Claims, 1 Drawing Sheet

(56) References Cited

U.S. PATENT DOCUMENTS

| | | | | |
|---|---|---|---|---|
| 6,673,383 | B2 | 1/2004 | Cain et al. | |
| 6,797,291 | B2 | 9/2004 | Richardson | |
| 6,835,397 | B2 | 12/2004 | Lee et al. | |
| 2004/0118422 | A1 | 6/2004 | Lundin et al. | |
| 2005/0089548 | A1 | 4/2005 | Virgalitto et al. | |
| 2005/0178398 | A1 | 8/2005 | Breslin et al. | |
| 2005/0244521 | A1 | 11/2005 | Strickland et al. | |
| 2006/0191548 | A1 | 8/2006 | Strickland et al. | |
| 2007/0186941 | A1 | 8/2007 | Holton et al. | |
| 2007/0269386 | A1* | 11/2007 | Steen | A61K 9/0056 424/48 |
| 2008/0029110 | A1 | 2/2008 | Dube et al. | |
| 2008/0209586 | A1 | 2/2008 | Dube et al. | |
| 2009/0025741 | A1* | 1/2009 | Crawford | B65B 11/48 131/359 |
| 2010/0170522 | A1* | 7/2010 | Sun | A24B 13/00 131/274 |
| 2010/0275936 | A1* | 11/2010 | Bivehed | A24B 13/00 131/119 |
| 2010/0291245 | A1* | 11/2010 | Gao | A61K 9/0056 424/751 |
| 2011/0104218 | A1* | 5/2011 | Karles | B01J 13/22 424/463 |
| 2011/0232657 | A1* | 9/2011 | Karles | A24B 15/186 131/300 |
| 2012/0045553 | A1* | 2/2012 | Sengupta | A23L 1/22016 426/96 |
| 2012/0118310 | A1* | 5/2012 | Cantrell | A23G 1/48 131/356 |

OTHER PUBLICATIONS

International Search Report and Written Opinion in International Application No. PCT/US2013/046798, dated Oct. 7, 2013, 12 pages.

Krochta et al., "Edible and Biodegradable Polymer Films: Challenges and Opportunities," Food Technology, 1997, 51:61-74.

Nussinovitch, *Water-Soluble Polymer Applications in Foods,* Blackwell Science, 2003 (Table of Contents Only).

Tso, *Tobacco: Production, Chemistry and Technology,* 1999, Davis and Nielsen, eds., chapter 1.

* cited by examiner

SMOKELESS TOBACCO LIPID GRANULES

CROSS-REFERENCE TO RELATED APPLICATIONS

This application claims priority to U.S. Provisional Application Ser. No. 61/662,060, filed on Jun. 20, 2012, which is hereby incorporated by reference.

TECHNICAL FIELD

This disclosure relates to lipid granules and a method of producing the same. The lipid granules can be used to form or to flavor smokeless tobacco products.

BACKGROUND

Smokeless tobacco is tobacco that is placed in the mouth and not combusted. There are various types of smokeless tobacco including: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

SUMMARY

A smokeless tobacco product is described that includes a plurality of tobacco lipid granules. Each tobacco lipid granule has a core and at least one layer surrounding the core. The core includes at least one lipid. Layers overlying the core can include tobacco particles, flavorants, carbohydrates, water soluble polymers, salts, sweeteners, binders, or combinations thereof. The lipid granules can exhibit various flavor profiles and textures when used by an adult tobacco consumer.

The core includes a lipid. The lipid can be selected from monoglycerides, diglycerides, triglycerides, and combinations thereof. In some embodiments, the lipid is a hydrogenated soybean oil. The core can also include additional ingredients within a matrix of the lipid. In certain embodiments, the core includes a mixture of lipid, binder, and flavorant. In some embodiments, one or more carbohydrates, water soluble polymers, flavorants, salts, sweeteners, or combinations thereof are included within a matrix of the lipid or a combination of lipid and binder. In some embodiments, powdered tobacco is included in the core within a matrix of the lipid. The tobacco particles can have an average diameter of less than 100 micrometers. The core can have a diameter of greater than 1 millimeter. In some embodiments, the core has a diameter of less than 5 millimeters. The core can have a diameter of between 1 millimeter and 5 millimeters. In some embodiments, the core has a diameter of between 2 and 4 millimeters, between 2.5 and 3.5 millimeters, or between 2.8 and 3.2 millimeters.

The granules include at least one layer overlying each core. The at least one layer can include a binder, a flavorant, a carbohydrate, a water soluble polymer, a water insoluble polymer, a salt, a sweetener, tobacco powder, or a combination thereof. In some embodiments, the granules include a plurality of layers overlying each core. An additional layer overlying the at least one layer and concentrically surrounding the core includes a different composition than the at least one layer. The additional layer can include a different composition than the at least one layer with regard to tobacco particle concentration, type of tobacco particles, binder, flavorant, or combination thereof. In some embodiments, the additional layer has a different concentration of tobacco. In some embodiments, the layers have different flavorants.

A flavorant included in the core and/or one or more layers overlying the core can be selected from the group consisting of licorice, wintergreen, cherry and berry type flavorants, Drambuie, bourbon, scotch, whiskey, spearmint, peppermint, lavender, cinnamon, cardamom, *Apium graveolens*, clove, cascarilla, nutmeg, sandalwood, bergamot, geranium, honey essence, rose oil, vanilla, lemon oil, orange oil, Japanese mint, cassia, caraway, cognac, jasmine, chamomile, menthol, ylang-ylang, sage, fennel, piment, ginger, anise, coriander, coffee, mint oils from a species of the genus Mentha, and combinations thereof. Tobacco extracts can also be added. For example, the tobacco extract can include two or more tobacco organoleptic components.

Tobacco within the granules (either within the core or one or more of the layers) can be non-fermented tobacco. In some embodiments, each granule can include dry snuff. In some embodiments, each granule includes tobacco particles of cured tobacco prepared from plants having less than 20 μg of DVT per $cm^2$ of green leaf tissue. In some embodiments, the tobacco is powdered tobacco. Powdered tobacco can be incorporated into a matrix of the lipid within the core and/or incorporated into one or more layers overlying the core. The tobacco particles of the powdered tobacco can have an average diameter of less than 100 micrometers.

The at least one layer and/or the core can include a binder. In some embodiments, the binder is selected from the group consisting of carboxymethyl cellulose, hydroxypropyl cellulose, hydroxyethyl cellulose, hydroxypropyl methyl cellulose, methyl cellulose, konjac, collagen, inulin, soy protein, whey protein, casein, wheat gluten, carrageenan, alginates, propylene glycol alginate, xanthan, dextran, pullulan, curdlan, gellan, locust bean gum, guar gum, tara gum, gum tragacanth, pectin, agar, zein, karaya, gelatin, psyllium seed, chitin, chitosan, gum acacia, polyvinyl pyrrolidone, polyethylene oxide, polyvinyl alcohol, and combinations thereof. For example, the binder can include a hydroxyl containing compound and a dextrin or dextrin derivative.

The granules can be generally spherical. The total diameter of the granules can have a diameter of between 1.1 millimeters and 6 millimeters.

The tobacco particles can include a non-fermented tobacco. In some embodiments, the tobacco particles include dry snuff. In some embodiments, the tobacco particles are cured tobacco particles prepared from tobacco plants having less than 20 μg of DVT per $cm^2$ of green leaf tissue. The tobacco particles in the at least one layer can have an average diameter of less than 100 micrometers.

The smokeless tobacco product can consist of a plurality of the granules. In other embodiments, the smokeless tobacco product includes additional components. For example, the smokeless tobacco product can include a pouch holding the plurality of granules. In some embodiments, the pouch can include an edible film. In some embodiments, the pouch includes a plurality of pores. In some embodiments, the smokeless tobacco product includes loose smokeless tobacco having the plurality of granules dispersed within the loose smokeless tobacco. The loose smokeless tobacco to granule ratio for the smokeless tobacco product can be between 1:5 and 5:1 by weight.

The smokeless tobacco product can include a flavor profile having two or more flavors each having a peak flavor intensity that is perceptible at different times or concurrently during consumption. For example, each granule can provide a flavor profile. A plurality of granules within a smokeless tobacco product can provide the same or different flavor profiles.

The lipid cores can be created by supplying a mixture including a lipid to a sphere forming machine. In some embodiments, the sphere forming machine is a bead making machine. For example, the sphere forming machine can be the Multi-Granulator, Model MC-55, or the Benchtop Marumerizer Model #QJ-230T-1, which are sold by Fuji Paudal Co. Ltd. The mixture can include a lipid and a binder. In some embodiments, the mixture includes a flavorant, tobacco, a sweetener, and/or a solvent. The lipid cores can then be coated by fluidizing the lipid cores within a fluid bed processor having a rotor and spraying a binder solution or suspension into the fluidized bed containing the fluidized cores. In some embodiments, tobacco particles are also fed into the fluidized bed. The binding solution or suspension can include a flavorant. In some embodiments, the composition of the binder solution or suspension fed into the fluidized bed is changed to create multiple layers.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1A:
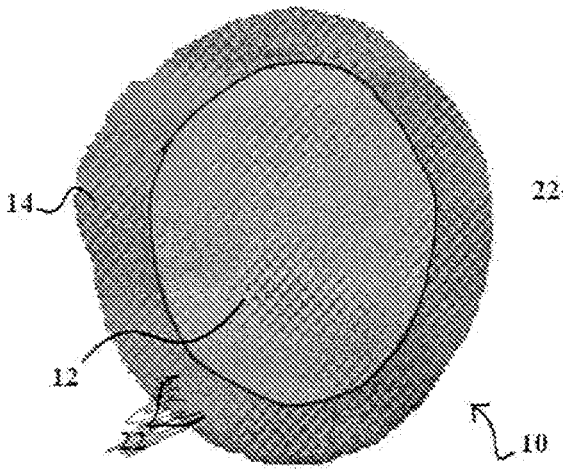
FIGS. 1A-1D depict cross-sectional views of lipid granules according to different embodiments.

This disclosure describes a smokeless tobacco product that includes a plurality of orally disintegrable granules 10. Examples of lipid granules 10 are shown in FIGS. 1A-1D. Each granule has a core 12 and at least one layer surrounding the core. The core 12 includes a lipid. Each granule can include more than one layer surrounding the lipid core. Thus, the present disclosure describes granules having different arrangements, methods of making the granules, and smokeless tobacco products including these granules. It has been discovered that granules according to the instant disclosure can confer unique flavor profiles on smokeless tobacco products.

The lipid core of the granules within a smokeless tobacco product can provide an adult tobacco consumer with an improved tactile and flavor release experience. For example, the lipids can provide a favorable mouth coating sensation and a soft mouth feel. The coating or coatings around the lipid cores can reduce clustering of the lipid cores and/or protect the lipid cores from deformation prior to use.

I. Cores

Cores 12 include at least one lipid. The lipid can be selected from monoglycerides, diglycerides, triglycerides, and combinations thereof. In some embodiments, the lipid is a hydrogenated soybean oil. The core 12 can have a diameter of greater than 1 millimeter. In some embodiments, the core 12 has a diameter of less than 5 millimeters. Cores 12 can have a diameter of between 1 millimeter and 5 millimeters. In some embodiments, the cores have a diameter of between 2 and 4 millimeters, between 2.5 and 3.5 millimeters, or between 2.8 and 3.2 millimeters.

The lipid core can include a binder. In some embodiments, the core includes between 5 and 70 weight percent lipid and between 30 and 95 weight percent binder. For example, the lipid cores can include a ratio of lipid to binder of between 1:1 and 1:5. Binders suitable for use in the core include orally compatible polymers, such as cellulosics (e.g., microcrystalline cellulose (MCC), carboxymethyl cellulose (CMC), hydroxypropyl cellulose (HPC), hydroxyethyl cellulose (HEC), hydroxypropyl methyl cellulose (HPMC), and methyl cellulose (MC)); natural polymers (e.g., starches and modified starches, konjac, collagen, inulin, soy protein, whey protein, casein, and wheat gluten); seaweed-derived polymers (e.g., carrageenan (kappa, iota, and lambda); alginates, (and propylene glycol alginate), microbial-derived polymers (e.g., xanthan, dextran, pullulan, curdlan, and gellan); extracts (e.g., locust bean gum, guar gum, tara gum, gum tragacanth, pectin (lo methoxy and amidated), agar, zein, karaya, gelatin, psyllium seed, chitin, and chitosan), exudates (e.g., gum acacia (arabic) and shellac), synthetic polymers (e.g., polyvinyl pyrrolidone, polyethylene oxide, and polyvinyl alcohol)). Other useful binders are known in the art, for example, see Krochta et al. Food Technology, 1997, 51:61-74; Glicksman Food Hydrocolloids CRC 1982; Krochta Edible Coatings and Films to Improve Food Quality Technomic 1994; Industrial Gums Academic 1993; Nussinovitch Water-Soluble Polymer Applications in Foods Blackwell Science 2003. In some embodiments, the binder can include hydroxypropyl methyl cellulose, which can be obtained from the Dow Chemical Company under the trade names HPMC E5, E15, and K4M.

Figure 1B:
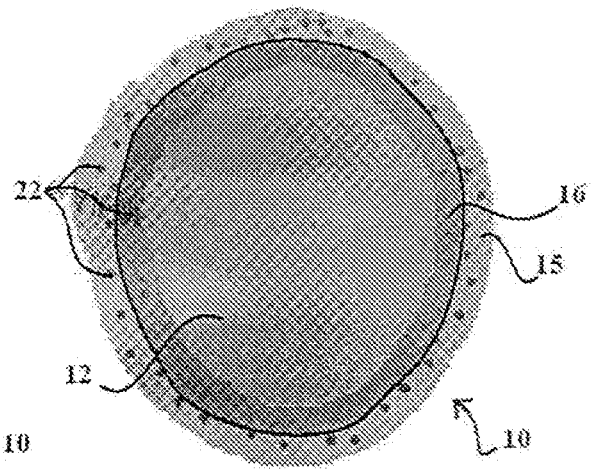
Figure 1C:
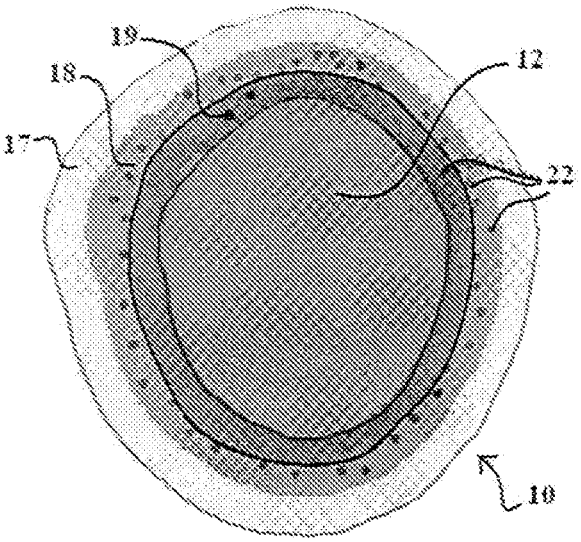
Figure 1D:
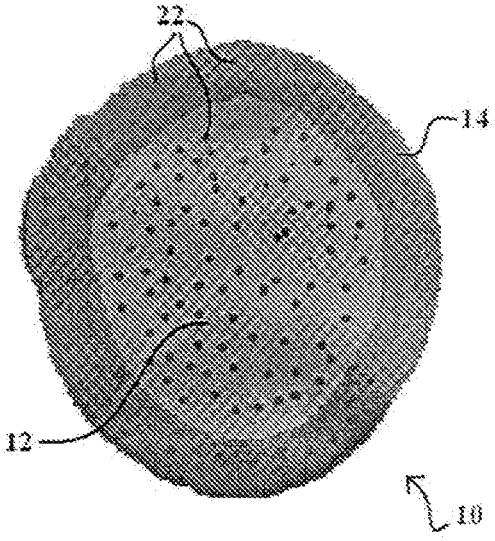

The cores 12 can include other constituents, such as flavorants, salts, sweeteners, or tobacco particles. For example, a core can include one or more sugars, such as glucose, lactose, or sucrose. Suitable salts include citric acid salts and sodium chloride. In some embodiments, such as shown in FIGS. 1A-1C, the core is tobacco free. In other embodiments, such as shown in FIG. 1D, the core includes tobacco particles dispersed within matrix of the lipid. In some embodiments, the core can include non-tobacco additives and/or actives, such as caffeine. In some embodiments, the core comprises at least 50 weight percent lipids. In some embodiments, the core can include less than 5 weight percent of ingredients other than lipid, tobacco, and flavorant.

The lipid cores 12 can be made by supplying a mixture of lipid, binder, and optionally tobacco particles, flavorants, and/or sweeteners to a sphere forming machine. For example, the sphere forming machine can be a bead making machine.

II. Layer(s)

Each granule 10 further includes at least one layer surrounding the lipid core 12. In some embodiments, as shown in FIGS. 1A and 1D, the granule 10 can include a single layer surrounding the core 12. As shown in FIG. 1D, some embodiments of layer 14 include a binder and tobacco particles 22. In other embodiments, the granule 10 includes a plurality of layers. FIG. 1B depicts an embodiment including two layers 15 and 16, with at least layer 15 including tobacco particles 22 and a binder. Layers 15 and 16 can differ in composition. For example, layers 15 and 16 can differ in the type or concentration of tobacco particles, the type of binder, and/or the type or concentration of flavorant. Other embodiments can include three layers. For example, as shown in FIG. 1C, a first layer 19 and a second layer 18 can include tobacco particles and a binder, while a third layer 17 does not include tobacco. The first and second layers 18 and 19 can differ in the type or concentration of tobacco particles, the type of binder, and/or the type or concentration of flavorant. The third layer 17 can include the same or a different flavorant from the first and second layers. In some embodiments, one or more of the layers can include other filler constituents, such as starch powders. In other embodiments, not specifically shown, the granules 10 can include any number of layers in which the layers can each have the same or different constituents in different orders. For example, a granule could include six or more alternating layers in which every other layer includes tobacco particles, each successive layer includes a different flavorant, and the binder varies between layers so different layers dissolve at different rates.

Binders

Binders suitable for use in the layers described herein include orally compatible polymers, such as cellulosics (e.g., carboxymethyl cellulose (CMC), hydroxypropyl cellulose (HPC), hydroxyethyl cellulose (HEC), hydroxypropyl methyl cellulose (HPMC), and methyl cellulose (MC)); natural polymers (e.g., starches and modified starches, konjac, collagen, inulin, soy protein, whey protein, casein, and wheat gluten); seaweed-derived polymers (e.g., carrageenan (kappa, iota, and lambda); alginates, (and propylene glycol alginate), microbial-derived polymers (e.g., xanthan, dextran, pullulan, curdlan, and gellan); extracts (e.g., locust bean gum, guar gum, tara gum, gum tragacanth, pectin (lo methoxy and amidated), agar, zein, karaya, gelatin, psyllium seed, chitin, and chitosan), exudates (e.g., gum acacia (arabic) and shellac), synthetic polymers (e.g., polyvinyl pyrrolidone, polyethylene oxide, and polyvinyl alcohol)). Other useful binders are known in the art, for example, see Krochta et al. Food Technology, 1997, 51:61-74; Glicksman Food Hydrocolloids CRC 1982; Krochta Edible Coatings and Films to Improve Food Quality Technomic 1994; Industrial Gums Academic 1993; Nussinovitch Water-Soluble Polymer Applications in Foods Blackwell Science 2003. In some embodiments, the binder can include hydroxypropyl methyl cellulose, which can be obtained from the Dow Chemical Company under the trade names HPMC E5, E15, and K4M.

Tobacco

One or more of the layers surrounding the core of a granule can contain a plurality of tobacco particles 22. Core 12 can optionally include tobacco particles dispersed in the lipid. For example, FIG. 1D depicts an embodiment of a granule having tobacco particles dispersed in a lipid matrix of the core 12. The average diameter of such tobacco particles is typically no more than ⅓ the size of the largest diameter of the core. In some embodiments, the average tobacco particle within a layer has an average diameter of no more than ⅕ the size of the average diameter of the core. For example, the core to tobacco particle average diameter ratio can be less than 10:1, less than 50:1, or less than 100:1. For example, the tobacco particles can have an average diameter of less than 200 micrometers (e.g., an average tobacco particle diameter of between 10 micrometers and 40 micrometers, between 40 micrometers and 60 micrometers, between 60 micrometers and 80 micrometers, between 80 micrometers and 120 micrometers, between 120 micrometers and 160 micrometers, or between 160 micrometers and 200 micrometers). In some embodiments, the average tobacco particle diameter is between 20 micrometers and 40 micrometers (e.g., between 25 micrometers and 35 micrometers). In some embodiments, the tobacco particles within the at least one layer have an average diameter of less than 100 micrometers (e.g., about 80 micrometers). For example, the tobacco particles can include micronized tobacco powder. The tobacco particles can be sized or made to disintegrate in the mouth (e.g., dissolve) or to give the perception of dissolvability (e.g., the tobacco does not produce a tactile experience in the mouth). For example, a micronized tobacco powder can have an average diameter of 27 micrometers and a ninety-ninth percentile diameter of 120 micrometers. Alternatively, the tobacco may be sized or made to provide a tactile experience in the mouth.

Depending on the desired characteristics, each layer can have a final tobacco concentration ranging from 0 percent to 99 percent by weight (e.g., between 10 and 90 percent by weight, between 25 and 75 percent by weight, or between 40 and 60 percent by weight). For example, a layer can contain between 15 and 35 percent by weight tobacco (e.g., about 25 percent by weight). In some embodiments, each granule within the plurality can include at least one layer including greater than 20 percent tobacco (e.g., greater than 40 percent tobacco, greater than 60 percent tobacco, or greater than 80 percent tobacco).

The tobacco used in the granule 10, either as the tobacco particles in the layers and/or within the core, is a tobacco suitable for use in smokeless tobacco products. The tobacco is any tobacco suitable for use in the smokeless tobacco products. By "tobacco" it is meant a part, e.g., leaves, flowers, and stems, of a member of the genus *Nicotiana*. Exemplary species of tobacco include *N. rustica, N. tabacum, N. tomentosiformis*, and *N. sylvestris*. Suitable tobaccos include fermented and unfermented tobaccos. In addition to fermentation, the tobacco can be processed using other techniques. For example, tobacco can be processed by heat treatment (e.g., cooking, toasting), flavoring, enzyme treatment, expansion and/or curing. Both fermented and non-fermented tobaccos can be processed using these techniques. In other embodiments, the tobacco can be unprocessed tobacco. Specific examples of suitable processed tobaccos include dark air-cured, dark fire-cured, burley, flue cured, and cigar filler or wrapper, as well as the products from the whole leaf stemming operation. For example, tobacco can be conditioned by heating, sweating and/or pasteurizing steps as described in U.S. Publication Nos. 2004/0118422 or 2005/0178398. Fermenting is typically characterized by high initial moisture content, heat generation, and a 10 to 20% loss of dry weight. See e.g., U.S. Pat. Nos. 4,528,993; 4,660,577; 4,848,373; and 5,372,149. In addition to modifying the aroma of the leaf, fermentation can change either or both the color and texture of a leaf. Also during the fermentation process, evolution gases can be produced, oxygen can be taken up, the pH can change, and the amount of water retained can change. See, for example, U.S. Publication No. 2005/0178398 and Tso (1999, Chapter 1 in *Tobacco: Production, Chemistry and Technology*, Davis & Nielsen, eds., Blackwell Publishing, Oxford). Cured, or cured and fermented tobacco can be further processed (e.g., cut, expanded, blended, milled or comminuted) prior to incorporation into the granules.

The tobacco can, in some embodiments, be prepared from plants having less than 20 μg of DVT per $cm^2$ of green leaf tissue. For example, the tobacco particles can be selected from the tobaccos described in U.S. Patent Publication No. 2008/0209586, which is hereby incorporated by reference. Tobacco compositions containing tobacco from such low- DVT varieties exhibit improved flavor characteristics in sensory panel evaluations when compared to tobacco or tobacco compositions that do not have reduced levels of DVTs.

Flavorants

The cores and/or the one or more layers can include one or more flavorants. Flavorants can produce a flavor release profile when the granules 10 are orally consumed. The flavor release profile can be customized by adjusting the ingredients and sizes of the layers. For example, by having a plurality of lipid granules each having the same pattern of layers, an adult tobacco consumer consuming the granules can identify a flavor profile.

Flavorants used within the granules 10 can be any flavorant known in the art. For example, suitable flavorants include wintergreen, cherry and berry type flavorants, various liqueurs and liquors such as Drambuie, bourbon, scotch, whiskey, spearmint, peppermint, lavender, cinnamon, cardamom, *Apium graveolens*, clove, cascarilla, nutmeg, sandalwood, bergamot, geranium, honey essence, rose oil, vanilla, lemon oil, orange oil, Japanese mint, cassia, caraway, cognac, jasmine, chamomile, menthol, ylang-ylang, sage, fennel, piment, ginger, anise, coriander, coffee, and mint oils from a species of the genus Mentha. Mint oils useful in the granules include spearmint and peppermint.

Other Layer Constituents

Depending on the desired characteristics, layers or lipid cores may also include fillers (e.g., starch, di-calcium phosphate, lactose, sorbitol, mannitol, and microcrystalline cellulose), soluble fiber (e.g., Fibersol from Matsushita), calcium carbonate, dicalcium phosphate, calcium sulfate, and clays), lubricants (e.g., lecithin, stearic acid, hydrogenated vegetable oil, mineral oil, polyethylene glycol 4000-6000 (PEG), sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides)), plasticizers (e.g., glycerine, propylene glycol, polyethylene glycol, sorbitol, mannitol, triacetin, and 1,3 butane diol), stabilizers (e.g., ascorbic acid and monosterol citrate, BHT, or BHA), artificial sweeteners (e.g., sucralose, saccharin, and aspartame), disintegrating agents (e.g., starch, sodium starch glycolate, cross carmellose, cross linked PVP), or other compounds (e.g., vegetable oils, surfactants, and preservatives). Some compounds display functional attributes that fall into more than one of these categories. For example, propylene glycol can act as both a plasticizer and a lubricant and sorbitol can act as both a filler and a plasticizer.

III. Smokeless Tobacco Products

A plurality of granules 10 can itself be a smokeless tobacco product or can be incorporated with other materials into a smokeless tobacco product. Smokeless tobacco compositions incorporating a plurality of granules 10 can contain, without limitation, moist or dry smokeless tobaccos including snus-style products, loose tobacco in a pouch or pack or snuff tobaccos. See, e.g., U.S. Patent Publication Nos. 2005/0244521 and 2006/0191548 for descriptions of a number of smokeless tobacco compositions. Smokeless tobacco compositions having granules 10 mixed therein can provide the smokeless tobacco composition with a desired flavor release profile. The loose smokeless tobacco to granule ratio for the smokeless tobacco product is not limited. In some embodiments, the loose smokeless tobacco to granule ratio is between 1 and 90 weight/weight (wet). For example, the loose smokeless tobacco to granule ratio can be between 30 and 65 weight/weight (wet).

Granules 10 can also be packaged with other smokeless tobacco products without the granules 10 being intermixed with the other smokeless tobacco products. For example, granules 10 can be packaged along with other smokeless tobacco products in a divided container, with the granules 10 in a different segment of the divided container. A divided container can allow an adult tobacco consumer to experience the granules alone, the other smokeless tobacco product(s) alone, or a combination of the products together. A plurality of different types of granules 10 could also be included in different sections of a divided container. In other embodiments, the granules 10 are encapsulated in one or more blisters inside the container of a smokeless tobacco product to allow for an adult tobacco consumer selectively increase or alter the flavor of the smokeless tobacco product. For example, an adult tobacco consumer can have a moist smokeless tobacco product container with multiple blister packs inside the lid, each blister pack having granules providing a different flavor profile, and thus the adult tobacco consumer can elect a particular flavor or combination of flavors or elect to not use any flavors at all. Furthermore, granules can be added to increase the flavor intensity after an initial use.

A plurality of the granules can, in some embodiments, be sold alone in packages for direct oral consumption. For example, granules 10 can be packaged loosely in sugar type paper packages, slide fastener plastic bags, blister packs, portion-control dispensers (e.g., like a pepper grinder), straws or tubes with sealed ends, and box-like containers. For example, a container can have a shape and size approximating that of a cigarette pack or cigarette lighter. In some embodiments, a plurality of granules 10 can be packaged in an open or highly porous wrapping material, (e.g., fabrics, paper or plastic films), with or without additional smokeless tobacco product. In other embodiments, a plurality of granules 10 can be packaged in a consumable package, (e.g., a pouch made of a pair of edible film strips sealed or adhered together along their edges). For example, the edible film used to produce a consumable package could be of the type described in U.S. Patent Publication No. 2005/0089548, which is hereby incorporated by reference. A plurality of different types of granules 10 can be packaged together. In some embodiments, a first plurality of granules 10 having a first flavor profile are packaged with a second plurality of granules 10 having a second and different flavor profile. The first and second pluralities of granules can be visually differentiated by having different exterior colors. Different granule groups can be mixed or segregated.

Mixtures of granules, with or without other smokeless tobacco compositions or other ingredients, can be molded, extruded, pressed, or otherwise formed into shaped smokeless tobacco pieces. In some embodiments, mixtures of granules, with or without other smokeless tobacco compositions or other ingredients, can be compressed to form a tablet or disc. A tablet could then be packaged and/or dispensed in a dispenser that includes stacked tablets and individually pushes out one tablet at a time upon activation of a dispensing mechanism. For example, granules 10 can be included in a non-dissolvable tobacco tablet or disc where the granules 10 are dispersed within a matrix of non-dissolvable smokeless tobacco material. A smokeless tobacco tablet or disc can also be made entirely of granules 10 pressed together. In other embodiments, a tablet could include a granule 10 layer on one side and a smooth texture of another smokeless tobacco product on the reverse side to provide a texture interplay Granules 10 can also be pressed into a bar or stick shape. Pluralities of granules can also be pressed into irregular cluster shapes. In some embodiments, clusters of granules 10 can include a lipid coating (e.g., steric acid). Granules 10 can also be pressed into a flexible tape, which can be rolled up for distribution. The granules can also be molded around preformed items, such as toothpicks, pretzel sticks, other small cylinder shapes, or a flexible carrier. For example, granules 10 can be molded into pearl-like beads on a string to form a tobacco granule necklace.

Granules 10 can also include outer coatings that can give the granules 10 desired bulk properties. For example, the outer coating can include a sticky coating that allows an adult tobacco consumer to pinch a plurality of granules 10 together for consumption. In other embodiments, granules 10 can include an outer coating that inhibits bonding between granules 10, such that the granules 10 will easily flow. In other embodiments, the materials used for the granules 10 can be selected to impart a desired compressibility giving a desired mouth feel. For example, in some embodiments, the granules 10 can have a compressibility approximating that of a tapioca ball. In other embodiments, the granules can be incompressible and designed to be crunched in an adult tobacco consumer's mouth.

Granules 10 can also be included with non-tobacco products. For example, granules 10 can be combined with a chewable gum to provide taste and/or texture to the gum. In some embodiments, the gum can include additional smokeless tobacco products. In other embodiments, granules 10 can be packaged along with a preformed object that can be dipped into a section of the packaging having granules 10 to coat the preformed object with granules 10 for consumption. The preformed object can be made of a number of consumable or non-consumable materials. For example, the preformed object can be a lipid soft tab or a pressed sugar stick. In some embodiments, the preformed object can include other smokeless tobacco products. In other embodiments, granules 10 can be included within crystallized confectionaries, such as crystallized maple syrup.

IV. Granule Formation

The lipid mixture is formed into beads using a bead making machine (e.g., the Fuji Paudal Co. Ltd: Multi-Granulator, Model MC-55 and Benchtop Marumerizer Model #QJ-230T-1). The mixture includes microcrystalline cellulose (MCC), lipid, and water. The mixture can also include tobacco powder, sweeteners, flavorants, and other additives. The tobacco powder can have an average size of about 35 microns. The beads are then encapsulated with a coating. The encapsulation process may be any encapsulation process known in the art, including spray chilling, spray drying, spinning disk, coacervation, or some form of fluid bed process. Examples of encapsulation processes are described in U.S. Pat. Nos. 3,913,847; 6,153,236; 6,251,478; 6,312,741; 6,616,954; 6,673,383; 6,797,291; and 6,835,397; the specifications, drawings and complete disclosures of which are incorporated herein by specific reference for all purposes. For example, the lipid cores can be coated using a fluidized bed reactor to coat the lipid cores.

The resulting lipid granules can be mixed with various blends of tobacco product. Liquid flavorants or sweeteners also may be used in the blend. Coatings on the lipid core can reduce adhesion between the lipid granules. The coating can also stabilize the dimensions of the granules. One or more coatings can have a higher melting temperature than the lipid core. In one exemplary embodiment, the melting point of the one or more coatings is 135.degree. F., or above. The granules can be stable in the pH, high moisture, and high salt environment formed while in contact with the tobacco product (or other product with moisture content) during storage, yet releases the flavor over time when the product is used.

Prophetic Example

Tobacco can be aged, fermented, pre-conditioned, cased, and milled to produce particles with an average diameter of about 3 mm. Lipid beads can be formed by adding a mixture of Encore 100 Palm Kernel oil (from Cargill); Avicel MCC PH-101; and water. Tobacco powder can also be added. The lipid beads can be coated using a GXR30 system from Vector Corporation, which is capable of drying, coating, granulating and powder layering. The tobacco particles can be fed to the GXR30 system from Vector Corporation using a screw powder-feeding apparatus. A coating binder, along with flavorants, sweeteners, and salts, can be sprayed as a binding solution into the GXR30 system. In some embodiments, the binder can be MCC from FMC Biopolymer. The system can mix a tobacco powder with the binding solution at a ratio of 1:1.3 tobacco powder-to-binding solution. The coated lipid beads can have a coating thickness of between 0.1 and 5.0 mm. The coated lipid bead can have an oven volatiles content of between 5 weight percent and 55 weight percent. The coated lipid beads, in some embodiments, have between 5 weight percent and 50 weight percent of tobacco (on a dry weight basis).

V. Other Embodiments

It is to be understood that, while the invention has been described herein in conjunction with a number of different aspects, the foregoing description of the various aspects is intended to illustrate and not limit the scope of the invention, which is defined by the scope of the appended claims. For example, a non-tobacco lipid bead could be made for tobacco and/or non-tobacco products. A non-tobacco lipid bead could have non-tobacco actives in the lipid core and/or in one or more of the layers. For example, a non-tobacco active could be caffeine. Other aspects, advantages, and modifications are within the scope of the following claims.

A number of embodiments have been described. Nevertheless, it will be understood that various modifications may be made without departing from the spirit and scope of this disclosure. For example, some smokeless tobacco products can include granules having a rapid release binding agent that can be used in the outer layer for immediate satisfaction, then a slow release agent in the intermediate layers for sustained flavor, and a lipid core for a final textural sensation. Still other smokeless tobacco products can include combinations of granules having different flavorant, flavor release, and disintegration properties. Accordingly, other embodiments are within the scope of the following claims.

What is claimed is:

1. A smokeless tobacco product comprising:

a plurality of granules, each of the plurality of granules including, a core including, a lipid, and a first binder, the core having a ratio of lipid to binder between 1:1 and 1:5, the first binder in an amount between 30 weight percent and 83 weight percent of the core, a plurality of tobacco particles within a matrix of the lipid and the first binder, and an additive including a carbohydrate, a water soluble polymer, a flavorant, a salt, a sweetener, or any combination thereof, and a plurality of layers surrounding the core, the plurality of layers including, a first layer surrounding the core and including a second binder, and a second layer surrounding the first layer and including the second binder, the second layer having a different composition than the first layer, the plurality of granules having an oven volatiles content ranging from 5 weight percent to 55 weight percent, wherein at least one of the plurality of layers has a melting point of 135° F. or above.

2. The smokeless tobacco product of claim 1, wherein the tobacco particles have an average diameter of less than 100 micrometers.

3. The smokeless tobacco product of claim 1, wherein the plurality of layers further includes the flavorant.

4. The smokeless tobacco product of claim 3, wherein the flavorant includes licorice, wintergreen, cherry and berry type flavorants, Drambuie, bourbon, scotch, whiskey, spearmint, peppermint, lavender, cinnamon, cardamom, *Apium graveolens*, clove, cascarilla, nutmeg, sandalwood, bergamot, geranium, honey essence, rose oil, vanilla, lemon oil, orange oil, Japanese mint, cassia, caraway, cognac, jasmine, chamomile, menthol, ylang-ylang, sage, fennel, piment, ginger, anise, coriander, coffee, mint oils from a species of the genus Mentha, or any combination thereof.

5. The smokeless tobacco product of claim 1, wherein the second layer and the first layer include different tobacco particle concentrations.

6. The smokeless tobacco product of claim 1, wherein the smokeless tobacco product includes a flavor profile having two different flavors, each of the two different flavors being configured to have a peak flavor intensity being perceptible at different times during consumption in a standardized sensory evaluation.

7. The smokeless tobacco product of claim 1, wherein each granule further comprises:

non-fermented tobacco.

8. The smokeless tobacco product of claim 1, wherein each granule further comprises:

tobacco particles of cured tobacco prepared from plants having less than 20 μg of DVT per $cm^2$ of green leaf tissue.

9. The smokeless tobacco product of claim 1, wherein the plurality of layers includes tobacco particles having an average diameter of less than 100 micrometers.

10. The smokeless tobacco product of claim 1, wherein each granule is generally spherical.

11. The smokeless tobacco product of claim 1, wherein the core further includes caffeine.

12. The smokeless tobacco product of claim 1, wherein the lipid includes palm kernel oil.

13. The smokeless tobacco product of claim 1, wherein the first binder includes microcrystalline cellulose.

14. The smokeless tobacco product of claim 1, wherein the second binder includes microcrystalline cellulose.

15. The smokeless tobacco product of claim 1, wherein the first binder and the second binder include microcrystalline cellulose.

16. A method of making a flavored granule comprising:

forming a core, the core including a lipid, and a first binder, the core having a ratio of lipid to binder between 1:1 and 1:5, the first binder in an amount between 30 weight percent and 83 weight percent of the core, a plurality of tobacco particles within a matrix of the lipid and the first binder, and an additive including a carbohydrate, a water soluble polymer, a flavorant, a salt, a sweetener, or any combination thereof, and coating the core with a plurality of layers, wherein the plurality of layers includes a first layer and a second layer, the first layer surrounds the core and includes a second binder, the second layer surrounds the first layer and includes the second binder, the second layer having a different composition than the first layer, the flavored granule having an oven volatiles content ranging from 5 weight percent to 55 weight percent, wherein at least one of the plurality of layers has a melting point of 135° F. or above.

17. A smokeless tobacco product comprising:

a plurality of granules, each granule including, a core including, a lipid, a first binder, a flavorant, and a plurality of tobacco particles, the core having a ratio of lipid to binder between 1:1 and 1:5 and the first binder in an amount between 30 weight percent and 83 weight percent of the core; and a plurality of layers surrounding the core, the plurality of layers including, a first layer surrounding the core and including a second binder, and a second layer surrounding the first layer and including the second binder, the second layer having a different composition than the first layer, the plurality of granules having an oven volatiles content ranging from 5 weight percent to 55 weight percent, wherein at least one of the plurality of layers has a melting point of 135° F. or above.

18. The smokeless tobacco product of claim 1, wherein the plurality of layers defines a thickness ranging from 0.1 to 5 millimeters.

* * * * *